US009404436B2

(12) United States Patent
Dentici et al.

(10) Patent No.: US 9,404,436 B2
(45) Date of Patent: Aug. 2, 2016

(54) METHOD FOR OPERATING AN INTERNAL COMBUSTION ENGINE USING A CORRECTED ENERGIZING TIME FOR FUEL INJECTIONS

(71) Applicant: GM GLOBAL TECHNOLOGY OPERATIONS LLC, Detroit, MI (US)

(72) Inventors: Ignazio Dentici, Turin (IT); Michele Bastianelli, Camerano (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 896 days.

(21) Appl. No.: 13/657,051

(22) Filed: Oct. 22, 2012

(65) Prior Publication Data

US 2013/0144508 A1 Jun. 6, 2013

(30) Foreign Application Priority Data

Oct. 20, 2011 (GB) ..... 1118093.2

(51) Int. Cl.
*F02D 45/00* (2006.01)
*F02D 41/00* (2006.01)
(Continued)

(52) U.S. Cl.
CPC ..... *F02D 45/00* (2013.01); *F02D 41/0097* (2013.01); *F02D 2041/1432* (2013.01); *F02D 2041/286* (2013.01); *F02D 2041/288* (2013.01)

(58) Field of Classification Search
CPC ..... F02D 2041/1432; F02D 2041/286; F02D 2041/288; F02D 41/0097; F02D 45/00; G01P 15/165
USPC ..... 701/32.8, 103–105, 110, 111; 123/406.24, 436, 445, 458, 472, 473, 123/475, 476, 478–480, 486, 490, 123/492–494; 73/114.13, 114.22, 114.24, 73/114.25
See application file for complete search history.

(56) References Cited

U.S. PATENT DOCUMENTS 4,385,402 A * 5/1983 Barrs ..... 455/339
4,736,429 A * 4/1988 Niyada et al. ..... 704/254
5,541,866 A * 7/1996 Sato et al. ..... 708/323
(Continued)

FOREIGN PATENT DOCUMENTS

FR 2949511 A1 3/2011
GB 2500890 A * 10/2013
(Continued)

*Primary Examiner* — Erick Solis
*Assistant Examiner* — Carl Staubach
(74) *Attorney, Agent, or Firm* — Ingrassia Fisher & Lorenz PC

(57) ABSTRACT

Methods and apparatus for operating an internal combustion engine are provided. The engine has an engine block defining a cylinder accommodating a reciprocating piston coupled to rotate a crankshaft, a fuel injector for injecting fuel inside the cylinder, and a crank position sensor positioned proximal to the crankshaft. A method includes commanding the fuel injector to perform a test fuel injection with a predetermined energizing time and using the crank position sensor to determine a crankshaft acceleration signal during the test fuel injection. The crankshaft acceleration signal is filtered and a value of an amplitude of a fundamental frequency component of the filtered crankshaft acceleration signal is determined. A correction factor of the predetermined energizing time is determined based on a difference between the determined value of the amplitude and a preset value thereof. The correction factor is used to correct an energizing time of subsequent fuel injections.

5 Claims, 6 Drawing Sheets

F

(51) Int. Cl.
*F02D 41/14* (2006.01)
*F02D 41/28* (2006.01)

(56) References Cited

U.S. PATENT DOCUMENTS 6,021,758 A * 2/2000 Carey et al. ..... 123/436
6,138,504 A * 10/2000 Lewis et al. ..... 73/114.33
7,926,329 B2 * 4/2011 Ostman ..... 73/114.13
9,074,547 B2 * 7/2015 Li et al.
2007/0118257 A1 * 5/2007 Iida ..... 701/29
2008/0276697 A1 * 11/2008 Ostman ..... 73/114.13
2009/0030593 A1 1/2009 Chauvin et al.
2009/0282903 A1 11/2009 Nagano et al.
2010/0168959 A1 * 7/2010 Iwami et al. ..... 701/37
2010/0312456 A1 12/2010 Nishimura et al.
2013/0024098 A1 * 1/2013 Li et al. ..... 701/104
2013/0325298 A1 * 12/2013 Li et al. ..... 701/104

FOREIGN PATENT DOCUMENTS

JP 59192860 A 11/1984
KR 20060035016 A 4/2006

* cited by examiner

METHOD FOR OPERATING AN INTERNAL COMBUSTION ENGINE USING A CORRECTED ENERGIZING TIME FOR FUEL INJECTIONS

TECHNICAL FIELD

This application claims priority to British Patent Application No. 1118093.2, filed Oct. 20, 2011, which is incorporated herein by reference in its entirety.

TECHNICAL AREA

The technical field relates to a method for operating an internal combustion engine.

BACKGROUND

Internal combustion engines are provided with cylinders, each one having a piston coupled to rotate a crankshaft. A fuel and air mixture is injected into a combustion chamber of each cylinder and ignited, resulting in hot expanding exhaust gasses causing reciprocal movement of the piston, the fuel being provided by injectors which in turn receive fuel at high pressure from a fuel common rail that is in fluid communication with a high pressure fuel pump.

Internal combustion engines are also generally equipped with an Electronic Control Unit (ECU) and the crankshaft is generally equipped with a crank position sensor suitable to send crankshaft signals to the ECU.

In order to improve the characteristics of exhaust emissions and reduce combustion noise in engines, particularly Diesel engines having a common-rail fuel injection system, a so-called multiple fuel injection pattern is adopted according to which the fuel quantity to be injected in each cylinder at each engine cycle is split into a plurality of injections. Thus, a typical multiple injection pattern may include preliminary injections (also known as pilot injections), which may be in turn split into two or more injection pulses, followed by one or more main injection pulses, followed by a number of after and post injection pulses.

The pilot injection pulses have an effect both on the level of combustion noise and exhaust emissions, and their duration or energizing time (ET) is generally mapped in memories of the electronic injection control unit. The mapped values of the energizing time are predetermined with reference to an injection system having nominal characteristics, i.e. components having no drifts.

However, the fuel quantity which is actually injected by an injector into the corresponding engine cylinder is inevitably affected by drifts, with respect to the desired or nominal value and this fact, during the vehicle lifetime, causes a variation of the combustion noise and exhaust emission characteristics.

Therefore fuel compensation strategies are used to correct the injected fuel quantity in a combustion engine during injector lifetime and periodically adjust the injector energizing time in order to have repetitive performance and accuracy in the fuel injected quantity along the life of the injector.

Also, pilot injections are in the range of a strong non-linearity of the injector performance and therefore more in need of being subjected to a compensation strategy.

To correct the fuel injected quantity, the injector energizing time strategy runs during engine overruns, for example when the automotive vehicle's driver releases the pressure on the accelerator pedal.

During these overruns, the Electronic Control Unit of the engine commands a calibratable test injection (e.g. 1 $mm^3$ of fuel) in one of the cylinder of the engine, while the other injectors are de-energized.

The injected fuel quantity is proportional to the crankshaft acceleration, and injector energizing time strategies process crankshaft timing in order to obtain a signal that is proportional to the acceleration and so to the injected quantity.

The crankshaft acceleration signal is processed taking into account the following considerations.

In an internal combustion reciprocating engine, the gas-pressure torque in each cylinder is a periodic function due to the thermodynamic cycle. In a 4-stroke engine the gas-pressure torque has a period of 720° CR (frequency 0.5 w). Therefore the gas-pressure torque in a 4-stroke engine can be expressed by means of a Fourier's series having fundamental frequency 0.5 w (so the frequencies involved in the series are 0.5 w, 1.0 w, 1.5 w, 2.0 w, 2.5 w, 3.0 w, etc. . . . ). The fundamental frequency having frequency 0.5 w is called component of order 0.5. It has a period of 720° CR.

The injector energizing time signal processing strategy selects the order 0.5 (injection order for an engine where only 1 cylinder is firing and the others are not firing, meaning that there is 1 firing event each 720° CR) and compares this signal to a predefined threshold in order to detect the correct injector energizing time for the pilot injected fuel quantity.

However crankshaft signal is very sensitive to noise, and noise frequency can be dependent from the driveline. From experience, especially in case of higher gears, the characteristic driveline resonance frequency is very close to the firing order (0.5) selected for the injector energizing time learning strategy; this generates errors in the correct energizing time estimation with negative effects on noise, emissions and drivability, and, in some cases, leads to the deactivation of the learning strategy.

From an analysis on different drivelines and applications to detect the noisy resonance frequency of the high gears, it is possible to obtain the following results for the gear dependent noisy frequency:

EXAMPLE 1

Gear 5->noisy frequency 0.4
Gear 6->noisy frequency 0.488

EXAMPLE 2

Gear 5->noisy frequency 0.357
Gear 6->noisy frequency 0.4465

In addition, drivelines can have a noisy frequency that is not gear dependent. All these noisy frequencies are close to the firing frequency of order 0.5 and they can also change due to driveline tolerances, production spread and aging.

In these cases, a classic approach to the crankshaft signal processing for injector energizing time strategy is not sufficient to obtain a valuable signal.

This problem is even more serious considering that many vehicles have, for fuel savings reason, high gear ratios.

Moreover, in numerous cases, depending on driving styles in particular on highways, injector energizing time strategies that operate when the vehicle is in a high gear are generated.

Accordingly, at least one object herein is to extend the fuel delivery compensation strategy to higher gears in case of noisy driveline.

Another object is to provide a method for compensating fuel delivery without using complex devices and by taking advantage from the computational capabilities of the Electronic Control Unit (ECU) of the vehicle.

Another object of the present disclosure is to meet these goals by means of a simple, rational and inexpensive solution.

It is at least one object herein to provide a motor vehicle or a method for controlling a motor vehicle in which the guidance of the motor vehicle is made substantially more comfortable through simple measures. In addition, other objects, desirable features and characteristics will become apparent from the subsequent summary and detailed description, and the appended claims, taken in conjunction with the accompanying drawings and this background.

SUMMARY

In an exemplary embodiment, a method for operating an Internal Combustion Engine is provided. In accordance with the method, an engine comprises an engine block defining a cylinder accommodating a reciprocating piston coupled to rotate a crankshaft, a fuel injector for injecting fuel inside the cylinder, and a crank position sensor positioned proximal to the crankshaft. The method comprises the steps of:

commanding the fuel injector to perform a test fuel injection with a predetermined energizing time;

using the crank position sensor to determine a crankshaft acceleration signal during the test fuel injection, filtering the determined crankshaft acceleration signal, determining a value of an amplitude of a fundamental frequency component of the filtered crankshaft acceleration signal, determining a correction factor of the energizing time on the basis of a difference between the determined value of the amplitude of the fundamental frequency component and a preset value thereof, and using the correction factor to correct the energizing time of subsequent fuel injections performed by the fuel injector, wherein the filtering of the crankshaft acceleration signal comprises the steps of:

identifying a frequency of the crankshaft acceleration signal to be filtered, and filtering out the identified frequency from the crankshaft acceleration signal.

With regards to this embodiment, especially in case of high gears, when an injector energizing time strategy is performed for correcting the fuel delivery of a pilot injection, the noise frequency generated by the driveline that is generally close to the fundamental frequency of order 0.5 of the crankshaft acceleration signal is filtered out, it possible to obtain a cleaner signal to perform the injector energizing time strategy.

A cleaner signal improves the accuracy of the injector energizing time strategy with benefits on reduction of noise and emissions and improved drivability.

According to a further embodiment, the step of identification of a frequency of the crankshaft acceleration signal comprises a search for a local maximum and a local minimum of the crankshaft acceleration signal in a predetermined time interval to determine the half period of the signal and consequently its frequency and the step of assuming the frequency as a noise frequency of the crankshaft acceleration signal.

In this regard, a quick procedure to identify the noise frequency of the crankshaft acceleration signal is provided.

In a further embodiment, the step of filtering out the identified noise frequency from the crankshaft acceleration signal comprises the use of a notch filter calibrated on the identified noise frequency of the crankshaft acceleration signal.

With this embodiment, a straightforward procedure to eliminate or attenuate the noise frequency of the crankshaft acceleration signal is provided.

According to another embodiment, the filtering procedure comprises a step of identification of an optimal notch filter for filtering out the identified frequency from the crankshaft acceleration signal.

In this regard, the best filter to filter out the noise frequency is determined starting from a typical noise frequency for a certain driveline and a particular gear.

According to another embodiment, the step of identification of the optimal notch filter comprises the calibration of a plurality of notch filters, each of the notch filters being suitable to filter out a different frequency centered around a typical frequency of the noise of the crankshaft acceleration signal and the choice, among the plurality of notch filter, of the notch filter that minimizes a parameter proportional to the amplitude of the noise.

This embodiment can be implemented via software in the Electronic Control Unit of the engine in such way that each notch filter can be applied in parallel or using a for-cycle to the crankshaft acceleration signal.

According to another embodiment, the parameter proportional to the amplitude of the noise is calculated by filtering the crankshaft acceleration signal with each of the notch filters in order to obtain an output crankshaft acceleration filtered signal for each notch filter, each crankshaft acceleration filtered signal being compared to an average value of the crankshaft acceleration signal in order to calculate the deviation from the average value of each crankshaft acceleration filtered signal, and by integrating the deviation from the average value of each crankshaft acceleration filtered signal to calculate an integral value proportional to the amplitude of the noise for each crankshaft acceleration filtered signal.

This embodiment allows ranking of the various filters according to their effect on the signal that they are filtering.

According to another embodiment, the choice of the optimal notch filter is performed by selecting the minimum integral value between all the integral values and by choosing the notch filter that corresponds to the minimum integral value.

Another embodiment provides an apparatus for operating an Internal Combustion Engine, the engine comprising an engine block defining a cylinder accommodating a reciprocating piston coupled to rotate a crankshaft, a fuel injector for injecting fuel inside the cylinder, and a crank position sensor positioned proximal to the crankshaft, the apparatus comprising:

means for commanding the fuel injector to perform a test fuel injection with a predetermined energizing time;

means for using the crank position sensor to determine a crankshaft acceleration signal during the test fuel injection, means for filtering the determined crankshaft acceleration signal, means for determining a value of an amplitude of a fundamental frequency component of the filtered crankshaft acceleration signal, means for determining a correction factor of the energizing time on the basis of a difference between the determined value of the amplitude of the fundamental frequency component and a preset value thereof, and means for using the correction factor to correct the energizing time of subsequent fuel injections performed by the fuel injector, wherein the means for filtering the crankshaft acceleration signal comprises:

means for identifying a frequency of the crankshaft acceleration signal to be filtered, and means for filtering out the identified frequency from the crankshaft acceleration signal.

Still another embodiment provides an automotive system comprising an internal combustion engine, the engine comprising a cylinder accommodating a reciprocating piston coupled to rotate a crankshaft, a fuel injector for injecting fuel inside the cylinder, and a crank position sensor, suitable to send crankshaft signals to an Electronic Control Unit of the engine, wherein the Electronic Control Unit is configured to:

command the fuel injector to perform a test fuel injection with a predetermined energizing time;

use the crank position sensor to determine a crankshaft acceleration signal during the test fuel injection, filter the determined crankshaft acceleration signal, determine a value of an amplitude of a fundamental frequency component of the filtered crankshaft acceleration signal, determine a correction factor of the energizing time on the basis of a difference between the determined value of the amplitude of the fundamental frequency component and a preset value thereof, and use the correction factor to correct the energizing time of subsequent fuel injections performed by the fuel injector, wherein the filtering of the crankshaft acceleration signal comprises the steps of:

identifying a frequency of the crankshaft acceleration signal to be filtered, and filtering out the identified frequency from the crankshaft acceleration signal.

Still another embodiment provides an automotive system comprising an internal combustion engine, the engine comprising an engine block defining a cylinder accommodating a reciprocating piston coupled to rotate a crankshaft, a fuel injector for injecting fuel inside the cylinder, and a crank position sensor positioned proximal to the crankshaft, the sensor being suitable to send crankshaft signals to an Electronic Control Unit of the engine, wherein the Electronic Control Unit is configured to:

command the fuel injector to perform a test fuel injection with a predetermined energizing time;

use the crank position sensor to determine a crankshaft acceleration signal during the test fuel injection, filter the determined crankshaft acceleration signal, determine a value of an amplitude of a fundamental frequency component of the filtered crankshaft acceleration signal, determine a correction factor of the energizing time on the basis of a difference between the determined value of the amplitude of the fundamental frequency component and a preset value thereof, and use the correction factor to correct the energizing time of subsequent fuel injections performed by the fuel injector, wherein the filtering of the crankshaft acceleration signal comprises the steps of:

identifying a frequency of the crankshaft acceleration signal to be filtered, and filtering out the identified frequency from the crankshaft acceleration signal.

The method according to one embodiment can be carried out with the help of a computer program comprising a program-code for carrying out all the steps of the method described above, and in the form of computer program product comprising the computer program.

The computer program product can be embodied as a control apparatus for an internal combustion engine, comprising an Electronic Control Unit (ECU), a data carrier associated to the ECU, and the computer program stored in a data carrier, so that the control apparatus defines the embodiments described in the same way as the method. In this case, when the control apparatus executes the computer program all the steps of the method described above are carried out.

The method according to a further embodiment can be also embodied as an electromagnetic signal, said signal being modulated to carry a sequence of data bits which represents a computer program to carry out all steps of the method.

A still further embodiment of the disclosure provides an internal combustion engine specially arranged for carrying out the method claimed.

BRIEF DESCRIPTION OF THE DRAWINGS

The various embodiments will hereinafter be described in conjunction with the following drawing figures, wherein like numerals denote like elements, and wherein.

DETAILED DESCRIPTION

The following detailed description is merely exemplary in nature and is not intended to limit the various embodiments or the application and uses thereof. Furthermore, there is no intention to be bound by any theory presented in the preceding background or the following detailed description.

Exemplary embodiments will now be described with reference to the enclosed drawings without intent to limit application and uses.

Figure 1:
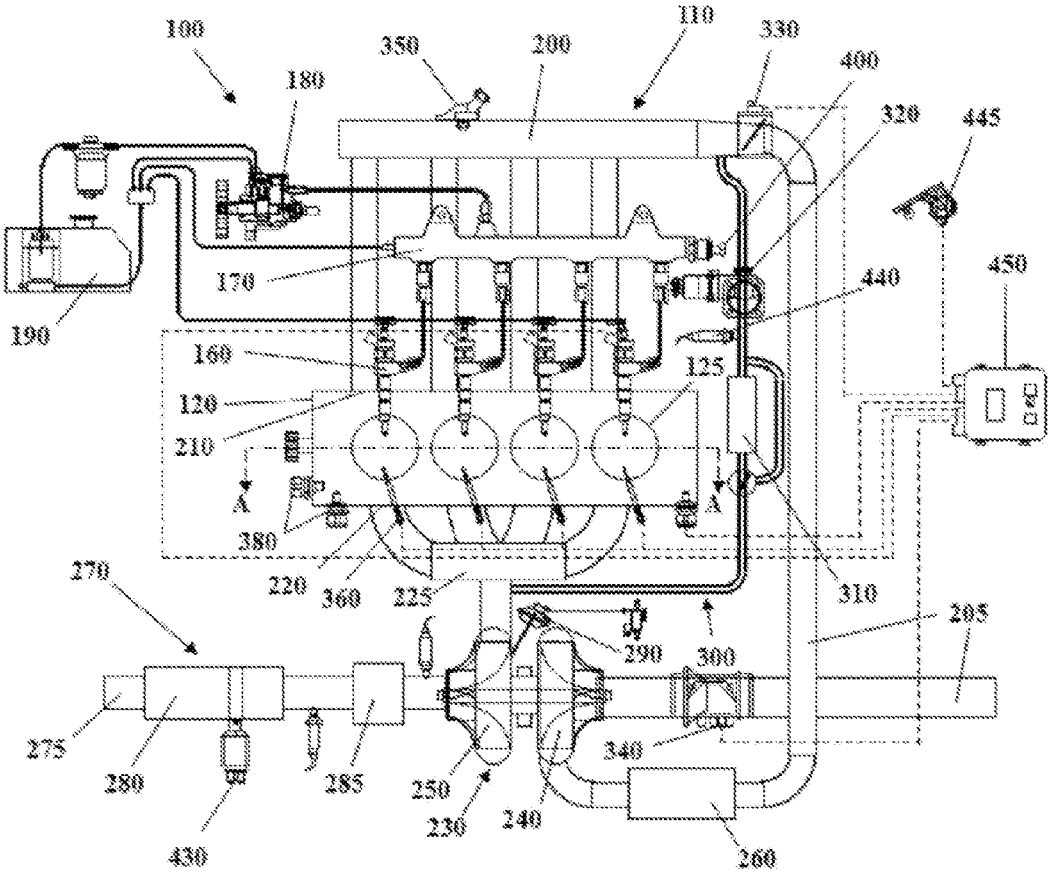
FIG. 1 shows an automotive system.
Figure 2:
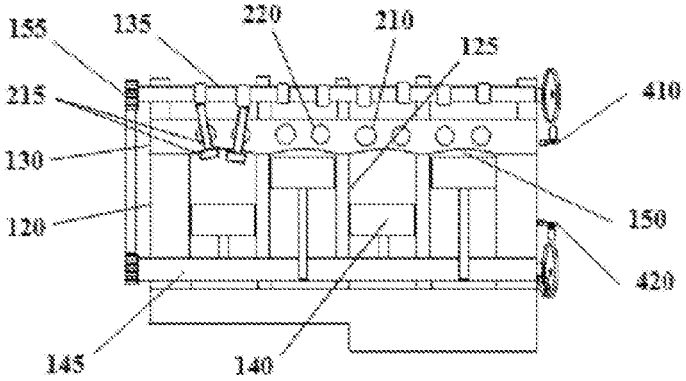
FIG. 2 is a cross-section of an internal combustion engine belonging to the automotive system of FIG. 1.

Some embodiments may include an automotive system 100, as shown in FIGS. 1 and 2, that includes an internal combustion engine (ICE) 110 having an engine block 120 defining at least one cylinder 125 having a piston 140 coupled to rotate a crankshaft 145. A cylinder head 130 cooperates with the piston 140 to define a combustion chamber 150. A fuel and air mixture (not shown) is disposed in the combustion chamber 150 and ignited, resulting in hot expanding exhaust gasses causing reciprocal movement of the piston 140. The fuel is provided by at least one fuel injector 160 and the air through at least one intake port 210. The fuel is provided at high pressure to the fuel injector 160 from a fuel rail 170 in fluid communication with a high pressure fuel pump 180 that increase the pressure of the fuel received a fuel source 190. Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an exhaust system 270. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The exhaust system 270 may include an exhaust pipe 275 having one or more exhaust aftertreatment devices 280. The aftertreatment devices may be any device configured to change the composition of the exhaust gases. Some examples of aftertreatment devices 280 include, but are not limited to, catalytic converters (two and three way), oxidation catalysts, lean $NO_x$ traps, hydrocarbon adsorbers, selective catalytic reduction (SCR) systems, and particulate filters. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

The automotive system 100 may further include an electronic control unit (ECU) 450 in communication with one or more sensors and/or devices associated with the ICE 110. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor 360, coolant and oil temperature and level sensors 380, a fuel rail pressure sensor 400, a cam position sensor 410, a crankshaft position sensor 420, exhaust pressure and temperature sensors 430, an EGR temperature sensor 440, and an accelerator pedal position sensor 445.

The crankshaft position sensor 420 is an electronic device used to monitor the position or rotational speed of the crankshaft 145 and can be mounted proximal to the crankshaft 145 itself in order to sense rotational displacement of the crankshaft 145 and send corresponding signals to the ECU 450.

Furthermore, the ECU 450 may generate output signals to various control devices that are arranged to control the operation of the ICE 110, including, but not limited to, the fuel injectors 160, the throttle body 330, the EGR Valve 320, the VGT actuator 290, and the cam phaser 155. Note, dashed lines are used to indicate communication between the ECU 450 and the various sensors and devices, but some are omitted for clarity.

Turning now to the ECU 450, this apparatus may include a digital central processing unit (CPU) in communication with a memory system, or data carrier 460, and an interface bus. The CPU is configured to execute instructions stored as a program in the memory system, and send and receive signals to/from the interface bus. The memory system may include various storage types including optical storage, magnetic storage, solid state storage, and other non-volatile memory. The interface bus may be configured to send, receive, and modulate analog and/or digital signals to/from the various sensors and control devices. The program may embody the methods disclosed herein, allowing the CPU to carryout out the steps of such methods and control the ICE 110.

Figure 3:
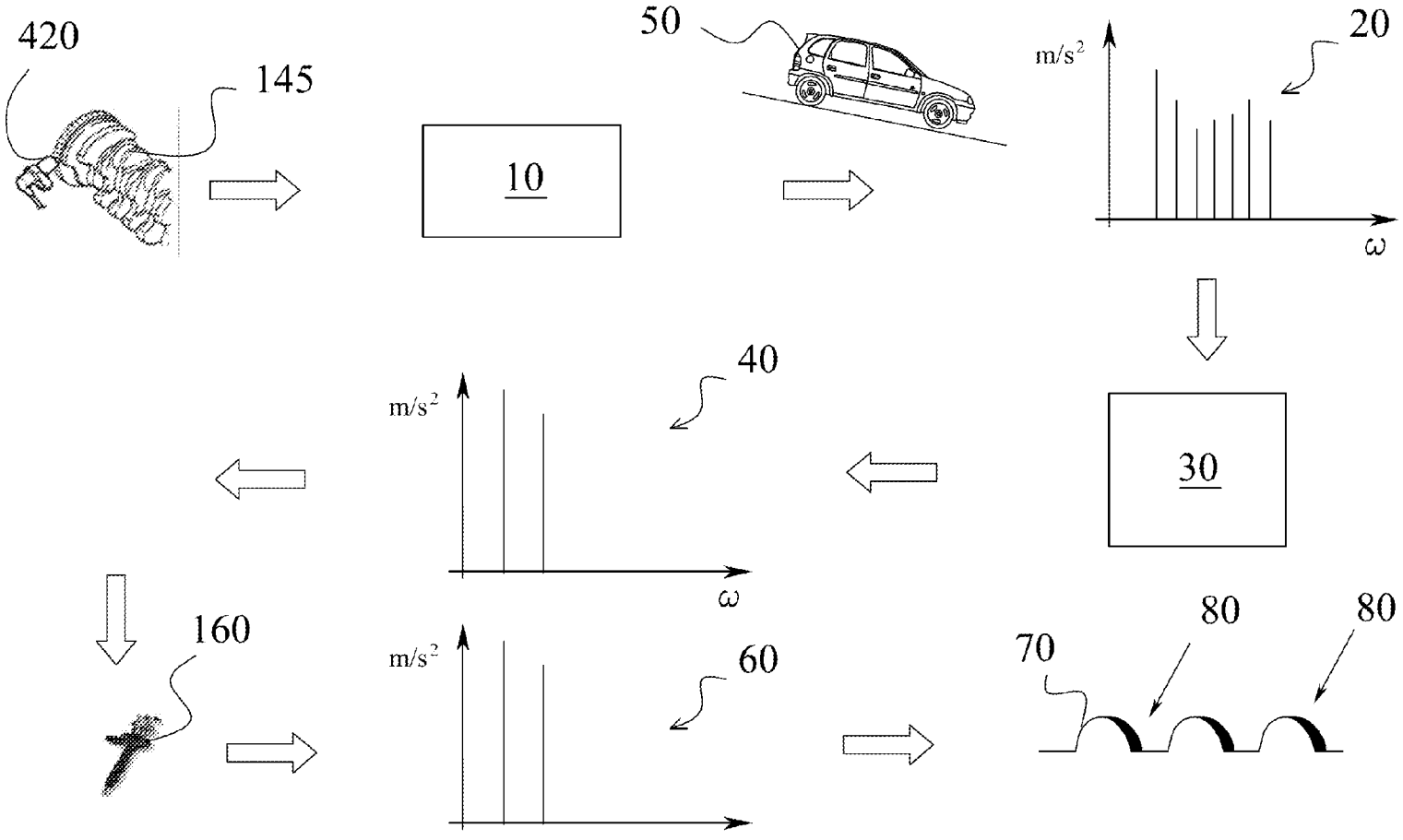
FIG. 3 is a schematic representation of a fuel delivery compensation strategy.

More specifically, FIG. 3 shows a schematic representation of a fuel delivery compensation strategy in accordance with an exemplary embodiment.

The strategy starts by reading a crankshaft signal by means of the crankshaft position sensor 420, then the signal is processed (block 10) in order to acquire a crankshaft acceleration signal.

In particular, the crankshaft acceleration signal is acquired in response to a fuel test quantity injected by a pilot injection when a vehicle 50 that contains the crankshaft 145 experiences a cutoff of fuel, for example when the driver releases the pressure on the accelerator pedal.

The processed signal is shown in graph 20, the signal being expressed by a series of frequencies 0.5 w, 1.0 w, 1.5 w, 2.0 w, 2.5 w, 3.0 w, etc. . . . , having fundamental frequency 0.5 w.

The signal is then processed by a series of mathematical techniques such as antialiasing, Bandpass Filtering (BPF) and average removal (block 30).

The resulting signal is represented in graph 40 where only the first two frequencies are shown.

Finally, the injector 160 is energized (graph 60) employing the correct injector energizing time for the injected fuel quantity, correcting therefore the fuel quantity injected 70 with a correction fuel amount 80 determined comparing the processed crankshaft signal to a predefined threshold signal.

According to an embodiment, an additional signal processing step is provided in order to filter the noise present in a crankshaft acceleration signal, especially in case of high gears.

According to an embodiment, the noisy frequency is filtered out employing a notch filter. A notch filter is a filter which rejects or attenuates a frequency inside a narrow range of frequencies. An exemplary notch filter used for this procedure is an Infinite Impulse Response (IIR) notch filter.

When an overrun condition occurs, an injector energizing time strategy is enabled and a test injection is performed on one cylinder 125.

The injector energizing time strategy can be enhanced in two different ways: frequency learning and filter learning.

Figure 4:
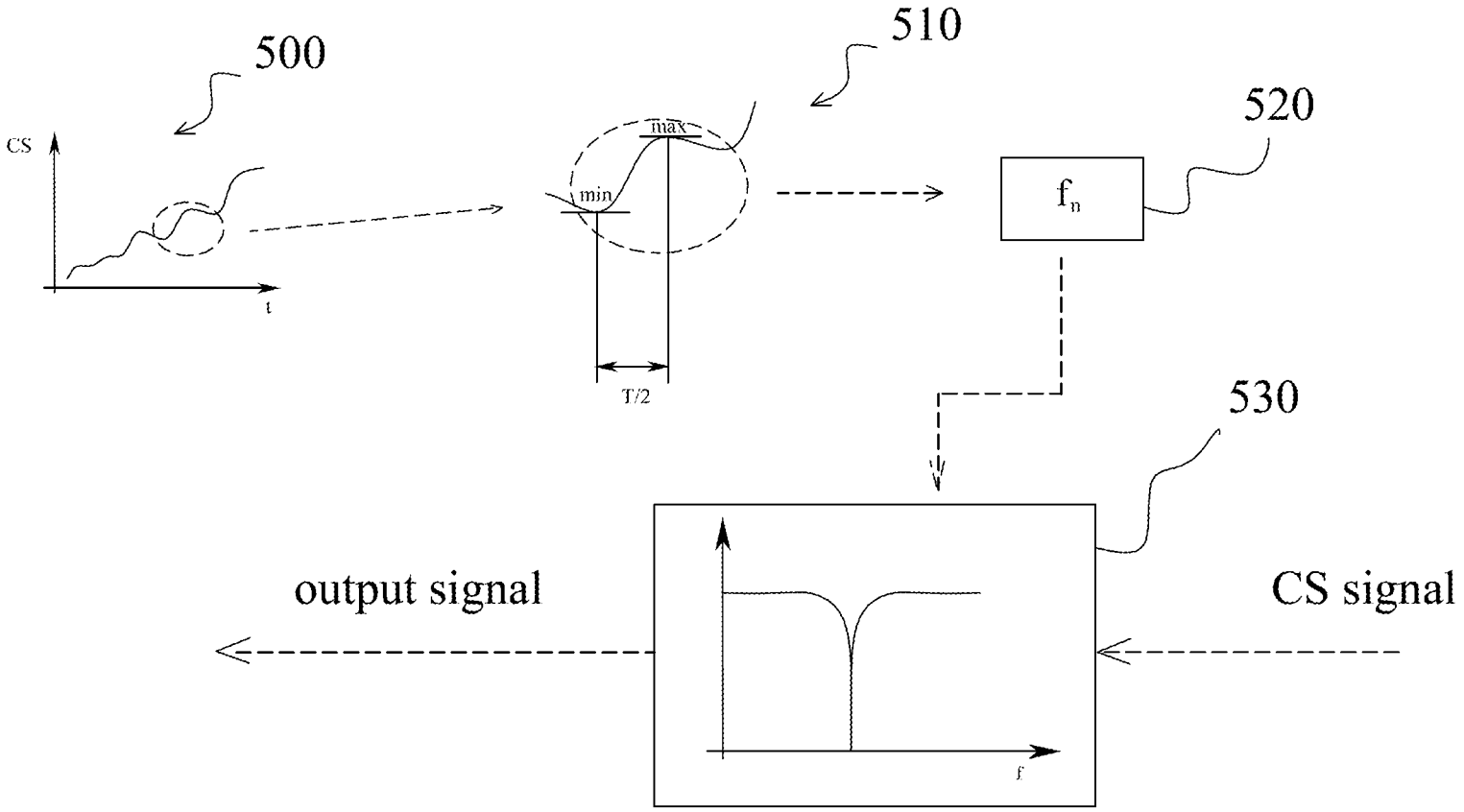
FIG. 4 is a schematic representation of a frequency learning procedure according to an embodiment.

For the frequency learning embodiment, the following procedure is employed on a crankshaft signal 500 (FIG. 4).

In an observation window or a predetermined time interval that starts when the test injection is active and is represented in graph 510 of FIG. 4, an algorithm searches a local minimum and a local maximum of the crankshaft processed signal CS.

Then the algorithm calculates the half period T/2 of the signal and consequently its frequency. The frequency is then assumed as a noise frequency $f_n$ of the crankshaft acceleration signal.

This frequency $f_n$ (block 520) is stored in nonvolatile memory of the data carrier 460. A calibratable Infinite Impulse Response (IIR) notch filter (block 530) is then implemented in the software of the Electronic Control Unit 450, the notch filter being calibrated to filter out frequency $f_n$.

Figure 5:
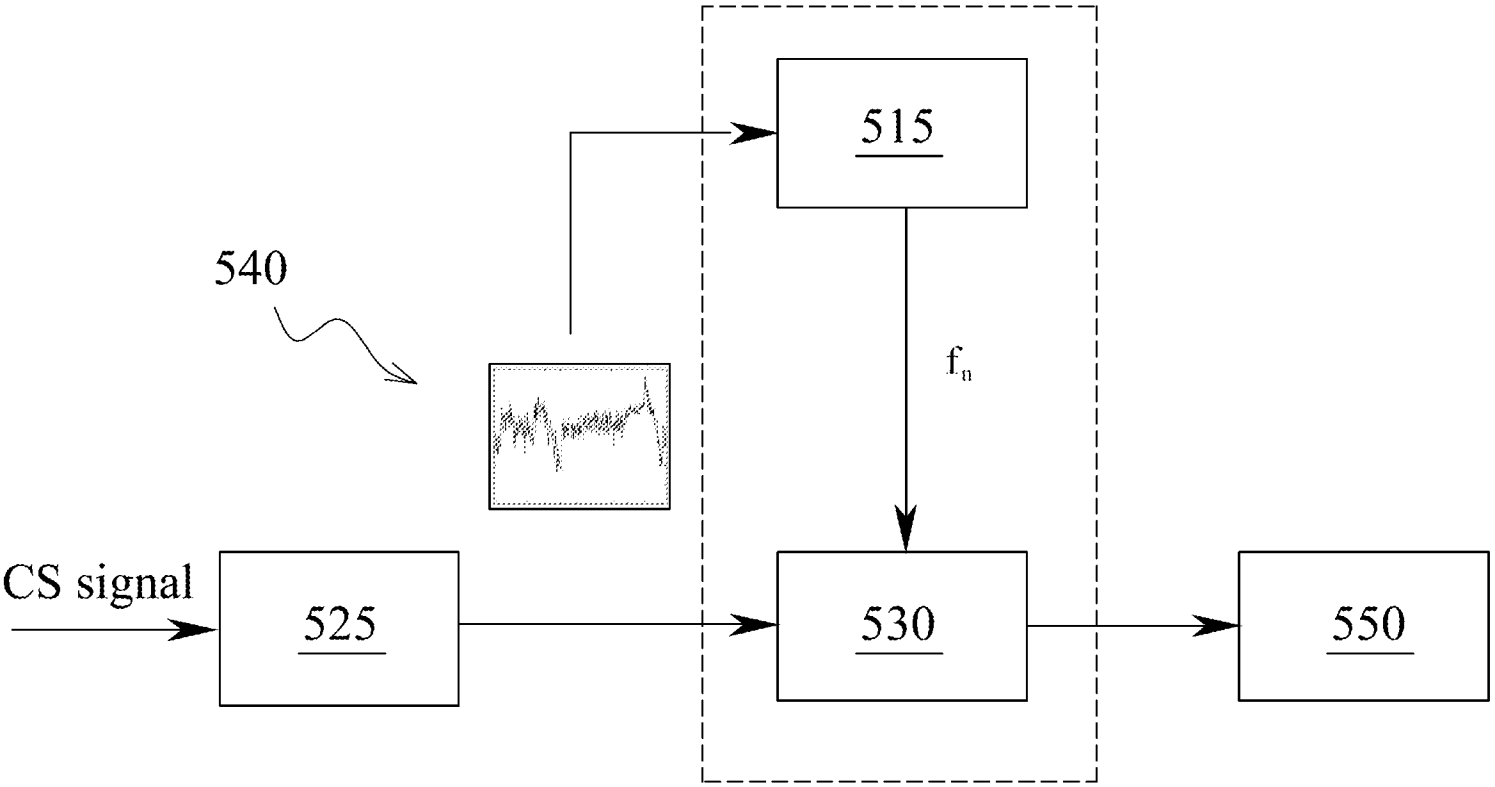
FIG. 5 is a schematic representation of a fuel delivery compensation strategy according to an embodiment.

FIG. 5 is a schematic representation of a fuel delivery compensation strategy according to an embodiment and using the noise frequency $f_n$ learned according to the previously described procedure.

In this case, the crankshaft acceleration signal is processed (in block 525) in order be expressed in terms of the fundamental frequency 0.5 w.

At the same time the crankshaft acceleration signal, schematically represented in graph 540, is subjected to the frequency learning procedure (block 515) in order to determine crankshaft signal noise frequency $f_n$.

Then the calibratable Infinite Impulse Response (IIR) notch filter (block 530) that is calibrated in such a way as to eliminate frequency $f_n$ is implemented.

Finally the notch filter 530 is applied to the crankshaft signal in order to filter out the noisy frequency $f_n$ and the output signal is used as feedback for the small quantity adjustment strategy (in block 550).

Figure 6:
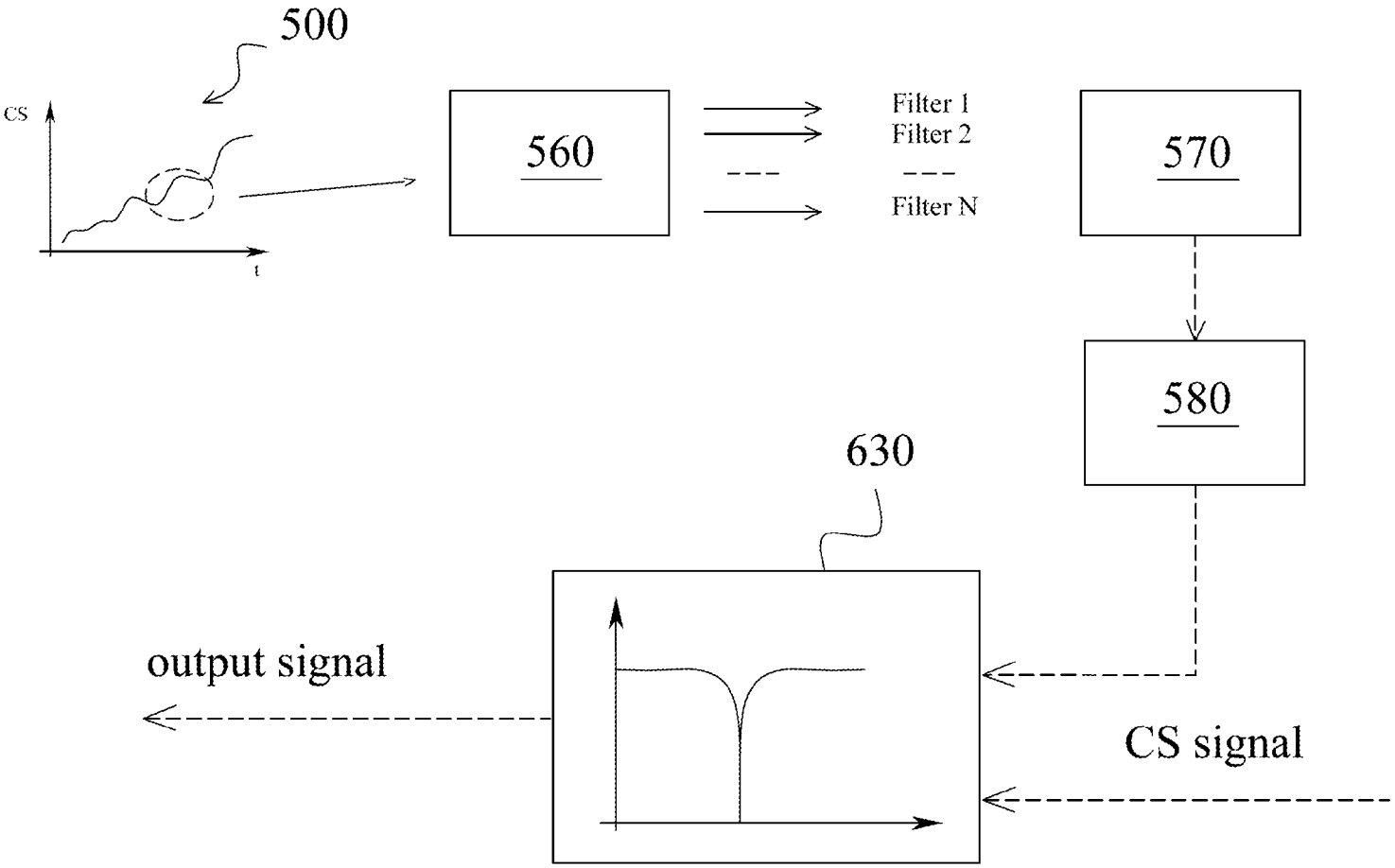
FIG. 6 is a schematic representation of a filter learning procedure according to an embodiment.

According to another embodiment, a filter learning procedure (exemplified in FIG. 6) is employed.

In an observation window for the crankshaft signal 500, a certain number N of Infinite Impulse Response (IIR) notch filters are calibrated around the typical noise frequency of the driveline for a certain application (block 560).

The calibration can be made with the help of a calculation tool. For example, if N=5, the notch filter 3 can be calibrated with central frequency $f_n$, filters 2 and 4 at $f_n \pm \Delta$, filters 1 and 5 $f_n \pm 2\Delta$, where $\Delta$ is a certain distance in frequency from frequency $f_n$.

All the N filters are applied to the crankshaft signal (in parallel or using a for-cycle) and therefore an output filtered signal F_out(i) is calculated.

In addition, the average value of the crankshaft signal CS_Avg is calculated.

Then for each filter, the deviation from the average value (F_out(i)−CS_Avg) proportional to the noise is calculated and integrated inside a predetermined interval of time.

At the end of the integration, each filter is associated with a corresponding integrated value F_int(i) that is proportional to the amplitude of the noise.

With a minimum research algorithm (block 570), the minimum F_int(j) between all the F_int(i) with i=1−N is calculated and the index j is stored in non-volatile memory of the data carrier 460.

This index is associated (block 580) with the filter 630 that has a central notch frequency closer to $f_n$ and so is the best filter for that driveline to reject the noise.

Figure 7:
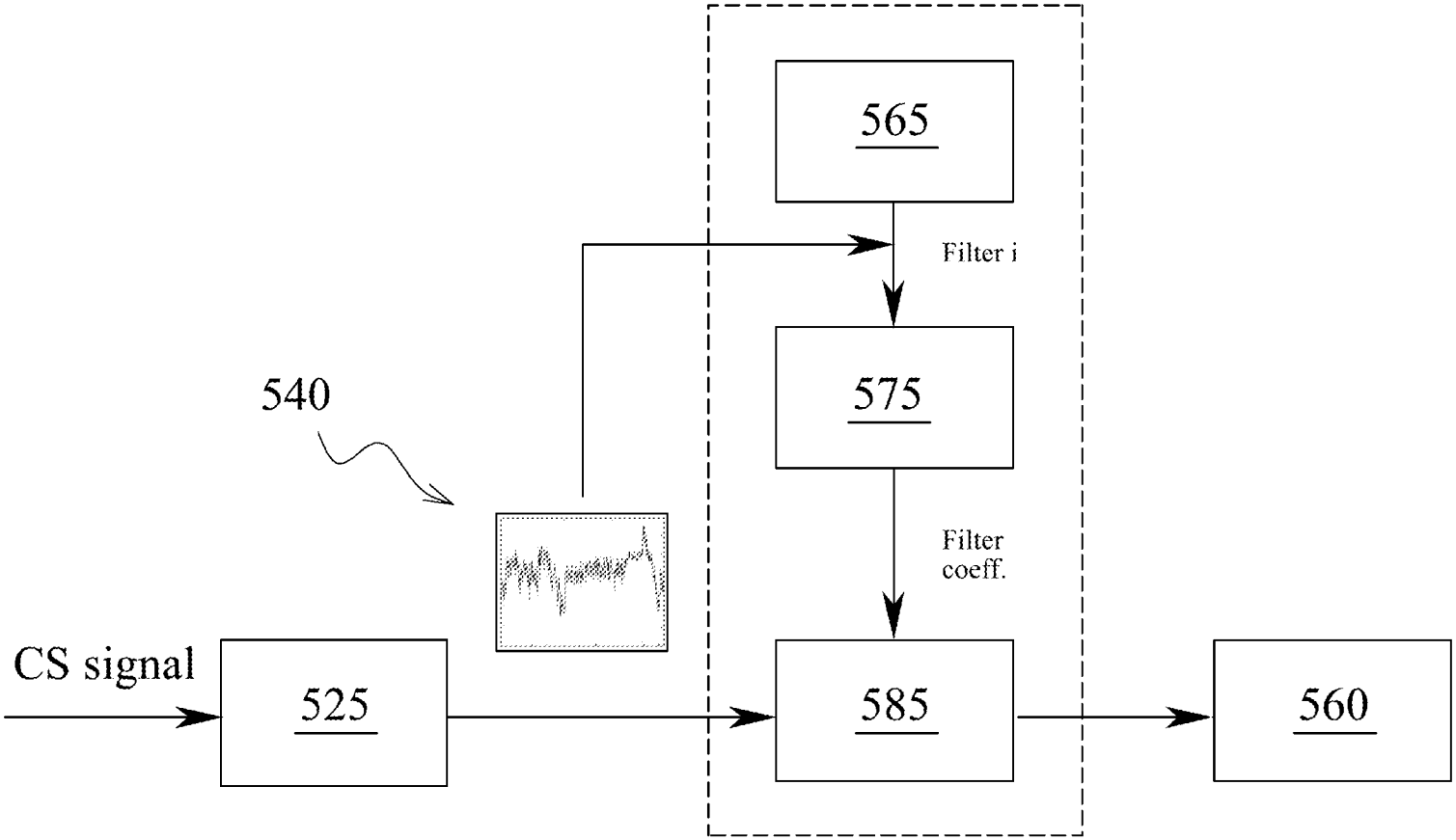
FIG. 7 is a schematic representation of a fuel delivery compensation strategy according to another embodiment.

FIG. 7 is a schematic representation of a fuel delivery compensation strategy according to an embodiment and using the learned filter according to the previously described procedure.

In this case, the crankshaft acceleration signal is processed (in block 525) in order be expressed in terms of the fundamental frequency 0.5 w.

At the same time the crankshaft acceleration signal schematically represented in graph 540 is subjected to the filter learning procedure (block 565) in order to determine a battery of filters calibrated around the typical noise frequency of the driveline for a certain application (block 565).

Then each filter is applied to the crankshaft signal in order select the various coefficients (block 575) and the best or optimal filter is selected (block 585).

Then the best Infinite Impulse Response (IIR) notch filter eliminating noise frequency $f_n$ is implemented.

Finally the best notch filter 630 is applied to the crankshaft signal in order to filter out the noisy frequency and the output signal can be used as feedback for the small quantity adjustment strategy (in block 550).

In all the embodiments, the frequency or the filter learning procedure shall be repeated after a certain number of kilometers traveled by the vehicle 50 to adjust for driveline aging.

The frequency or filter learning procedure can be repeated for each gear that has a noise frequency close to the firing order, and for each of such gear, a frequency, or a filter index shall be stored in the data carrier 460.

When the frequency or the filter learning has been performed, the signal processing section shall apply the notch filter to the crankshaft signal, and so the output signal can be used as feedback for the small quantity adjustment strategy.

The various embodiments provide improved reduction of noise and emissions and improved drivability.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A method for operating an internal combustion engine, the internal combustion engine comprising an engine block defining a cylinder accommodating a reciprocating piston coupled to rotate a crankshaft, a fuel injector for injecting fuel inside the cylinder, and a crank position sensor positioned proximal to the crankshaft, the method comprising the steps of:

commanding the fuel injector to perform a test fuel injection with a predetermined energizing time;

using the crank position sensor to determine a crankshaft acceleration signal during the test fuel injection;

filtering the crankshaft acceleration signal and obtaining a filtered crankshaft acceleration signal;

determining a value of an amplitude of a fundamental frequency component of the filtered crankshaft acceleration signal and obtaining a determined value of the amplitude of the fundamental frequency component;

determining a correction factor of the predetermined energizing time on a basis of a difference between the determined value of the amplitude of the fundamental frequency component and a preset value thereof; and using the correction factor to correct an energizing time of subsequent fuel injections performed by the fuel injector, wherein the filtering of the crankshaft acceleration signal comprises the steps of:

identifying a frequency ($f_n$) of the crankshaft acceleration signal to be filtered by searching for a local maximum and a local minimum of the crankshaft acceleration signal in a predetermined time interval to determine a half period (T/2) of the crankshaft acceleration signal and consequently its frequency and assuming the frequency as a noise frequency ($f_n$) of the crankshaft acceleration signal, and filtering out the frequency ($f_n$) from the crankshaft acceleration signal including:

identifying an optimal notch filter for filtering out the noise frequency ($f_n$) from the crankshaft acceleration signal, calibrating a plurality of notch filters, each of the plurality of notch filters being suitable to filter out a different frequency centered around a typical frequency of a noise of the crankshaft acceleration signal, selecting a minimum integral value (F_int(j)) between all integral values (F_int(i)) and by choosing the notch filter that corresponds to the minimum integral value (F_int(i)), and choosing, among the plurality of notch filters, a notch filter that minimizes a parameter proportional to an amplitude of the noise, wherein the parameter proportional to the amplitude of the noise is calculated by filtering the crankshaft acceleration signal with each of the plurality of notch filters in order to obtain an output crankshaft acceleration filtered signal (F_out(i)) for each of the plurality of notch filters, each output crankshaft acceleration filtered signal (F_out(i)) being compared to an average value of the crankshaft acceleration signal (CS_Avg) in order to calculate a deviation (F_out(i)−CS_Avg) from the average value of each output crankshaft acceleration filtered signal, and by integrating the deviation from the average value (F_out(i)−CS_Avg) of each output crankshaft acceleration filtered signal to calculate an integral value (F_int(i)) proportional to the amplitude of the noise for each output crankshaft acceleration filtered signal.

2. The method according to claim 1, wherein the step of filtering out the noise frequency ($f_n$) from the crankshaft acceleration signal comprises using a notch filter calibrated on the noise frequency ($f_n$) of the crankshaft acceleration signal.

3. An apparatus for operating an internal combustion engine, the internal combustion engine comprising an engine block defining a cylinder accommodating a reciprocating piston coupled to rotate a crankshaft, a fuel injector for injecting fuel inside the cylinder, and a crank position sensor positioned proximal to the crankshaft, the apparatus comprising:

means for commanding the fuel injector to perform a test fuel injection with a predetermined energizing time;

means for using the crank position sensor to determine a crankshaft acceleration signal during the test fuel injection and obtain a determined crankshaft acceleration signal;

means for filtering the determined crankshaft acceleration signal and obtaining a filtered crankshaft acceleration signal;

means for determining a value of an amplitude of a fundamental frequency component of the filtered crankshaft acceleration signal;

means for determining a correction factor of the predetermined energizing time on a basis of a difference between the value of the amplitude of the fundamental frequency component and a preset value thereof, and means for using the correction factor to correct an energizing time of subsequent fuel injections performed by the fuel injector, wherein the means for filtering the determined crankshaft acceleration signal comprises:

means for identifying a frequency ($f_n$) of the crankshaft acceleration signal to be filtered and obtaining an identified frequency ($f_n$) by searching for a local maximum and a local minimum of the crankshaft acceleration signal in a predetermined time interval to determine a half period (T/2) of the crankshaft acceleration signal and consequently its frequency and assuming the frequency as a noise frequency ($f_n$) of the crankshaft acceleration signal, and means for filtering out the identified frequency ($f_n$) from the crankshaft acceleration signal including identifying an optimal notch filter for filtering out the noise frequency ($f_n$) from the crankshaft acceleration signal, calibrating a plurality of notch filters, each of the plurality of notch filters being suitable to filter out a different frequency centered around a typical frequency of a noise of the crankshaft acceleration signal, selecting a minimum integral value (F_int(j)) between all integral values (F_int(i)) and by choosing the notch filter that corresponds to the minimum integral value (F_int(j)), and choosing, among the plurality of notch filters, a notch filter that minimizes a parameter proportional to an amplitude of the noise, wherein the parameter proportional to the amplitude of the noise is calculated by filtering the crankshaft acceleration signal with each of the plurality of notch filters in order to obtain an output crankshaft acceleration filtered signal (F_out(i)) for each of the plurality of notch filters, each output crankshaft acceleration filtered signal (F_out(i)) being compared to an average value of the crankshaft acceleration signal (CS_Avg) in order to calculate a deviation (F_out(i)−CS_Avg) from the average value of each output crankshaft acceleration filtered signal, and by integrating the deviation from the average value (F_out(i)−CS_Avg) of each output crankshaft acceleration filtered signal to calculate an integral value (F_int(i)) proportional to the amplitude of the noise for each output crankshaft acceleration filtered signal.

4. An automotive system comprising an internal combustion engine, the internal combustion engine comprising an engine block defining a cylinder accommodating a reciprocating piston coupled to rotate a crankshaft, a fuel injector for injecting fuel inside the cylinder, and a crank position sensor positioned proximal to the crankshaft, the crank position sensor being suitable to send crankshaft signals to an Electronic Control Unit of the internal combustion engine, wherein the Electronic Control Unit is configured to:

command the fuel injector to perform a test fuel injection with a predetermined energizing time;

use the crank position sensor to determine a crankshaft acceleration signal during the test fuel injection and obtain a determined crankshaft acceleration signal;

filter the determined crankshaft acceleration signal and obtain a filtered crankshaft acceleration signal;

determine a value of an amplitude of a fundamental frequency component of the filtered crankshaft acceleration signal and obtain a determined value of an amplitude of the fundamental frequency component;

determine a correction factor of the predetermined energizing time on a basis of a difference between the determined value of the amplitude of the fundamental frequency component and a preset value thereof, and use the correction factor to correct an energizing time of subsequent fuel injections performed by the fuel injector, wherein the filtering of the determined crankshaft acceleration signal comprises the steps of:

identifying a frequency ($f_n$) of the crankshaft acceleration signal to be filtered and obtaining an identified frequency ($f_n$) by searching for a local maximum and a local minimum of the crankshaft acceleration signal in a predetermined time interval to determine a half period (T/2) of the crankshaft acceleration signal and consequently its frequency and assuming the frequency as a noise frequency ($f_n$) of the crankshaft acceleration signal, and filtering out the identified frequency ($f_n$) from the crankshaft acceleration signal including:

identifying an optimal notch filter for filtering out the noise frequency ($f_n$) from the crankshaft acceleration signal, calibrating a plurality of notch filters, each of the plurality of notch filters being suitable to filter out a different frequency centered around a typical frequency of a noise of the crankshaft acceleration signal, selecting a minimum integral value (F_int(j)) between all integral values (F_int(i)) and by choosing the notch filter that corresponds to the minimum integral value (F_int(j)), and choosing, among the plurality of notch filters, a notch filter that minimizes a parameter proportional to an amplitude of the noise, wherein the parameter proportional to the amplitude of the noise is calculated by filtering the crankshaft acceleration signal with each of the plurality of notch filters in order to obtain an output crankshaft acceleration filtered signal (F_out(i)) for each of the plurality of notch filters, each output crankshaft acceleration filtered signal (F_out(i)) being compared to an average value of the crankshaft acceleration signal (CS_Avg) in order to calculate a deviation (F_out(i)−CS_Avg) from the average value of each output crankshaft acceleration filtered signal, and by integrating the deviation from the average value (F_out(i)−CS_Avg) of each output crankshaft acceleration filtered signal to calculate an integral value (F_int(i)) proportional to the amplitude of the noise for each output crankshaft acceleration filtered signal.

5. A computer readable medium embodying a computer program product, the computer program product comprising:

a computer program for operating an internal combustion engine, the internal combustion engine comprising an engine block defining a cylinder accommodating a reciprocating piston coupled to rotate a crankshaft, a fuel injector for injecting fuel inside the cylinder, and a crank position sensor positioned proximal to the crankshaft, the computer program configured to:

command the fuel injector to perform a test fuel injection with a predetermined energizing time;

use the crank position sensor to determine a crankshaft acceleration signal during the test fuel injection;

filter the crankshaft acceleration signal and obtain a filtered crankshaft acceleration signal;

determine a value of an amplitude of a fundamental frequency component of the filtered crankshaft acceleration signal and obtain a determined value of the amplitude of the fundamental frequency component;

determine a correction factor of the predetermined energizing time on a basis of a difference between the determined value of the amplitude of the fundamental frequency component and a preset value thereof; and use the correction factor to correct an energizing time of subsequent fuel injections performed by the fuel injector, wherein during the filtering of the crankshaft acceleration signal the computer program is configured to:

identify a frequency ($f_n$) of the crankshaft acceleration signal to be filtered by searching for a local maximum and a local minimum of the crankshaft acceleration signal in a predetermined time interval to determine a half period (T/2) of the crankshaft acceleration signal and consequently its frequency and assuming the frequency as a noise frequency ($f_n$) of the crankshaft acceleration signal, and filter out the frequency ($f_n$) from the crankshaft acceleration signal including:

identify an optimal notch filter for filtering out the noise frequency ($f_n$) from the crankshaft acceleration signal, calibrate a plurality of notch filters, each of the plurality of notch filters being suitable to filter out a different frequency centered around a typical frequency of a noise of the crankshaft acceleration signal, select a minimum integral value (F_int(j)) between all integral values (F_int(i)) and by choosing the notch filter that corresponds to the minimum integral value (F_int(j)), and choose, among the plurality of notch filters, a notch filter that minimizes a parameter proportional to an amplitude of the noise, wherein the parameter proportional to the amplitude of the noise is calculated by filtering the crankshaft acceleration signal with each of the plurality of notch filters in order to obtain an output crankshaft acceleration filtered signal (F_out(i)) for each of the plurality of notch filters, each output crankshaft acceleration filtered signal (F_out(i)) being compared to an average value of the crankshaft acceleration signal (CS_Avg) in order to calculate a deviation (F_out(i)−CS_Avg) from the average value of each output crankshaft acceleration filtered signal, and by integrating the deviation from the average value (F_out(i)−CS_Avg) of each output crankshaft acceleration filtered signal to calculate an integral value (F_int(i)) proportional to the amplitude of the noise for each output crankshaft acceleration filtered signal.

* * * * *